United States Patent [19]

Rabb

[11] 4,000,677

[45] Jan. 4, 1977

[54] MOUTH ORGAN

[76] Inventor: Teddy W. Rabb, P.O. Box 838, Olla, La. 71465

[22] Filed: Sept. 4, 1975

[21] Appl. No.: 610,136

[52] U.S. Cl. ..... 84/375

[51] Int. Cl.[2] ..... G10D 11/00

[58] Field of Search ..... 84/375, 378, 379, 377, 84/350

[56] References Cited

UNITED STATES PATENTS

| | | | |
|---|---|---|---|
| 320,440 | 6/1885 | McMahel | 84/375 |
| 341,670 | 5/1886 | Mann | 84/375 |
| 1,044,025 | 11/1912 | Combs | 84/375 |
| 1,651,448 | 12/1927 | Dusinberre | 84/375 |
| 1,857,400 | 5/1932 | Pidgeon | 84/375 |
| 1,974,370 | 9/1934 | Stamey | 84/375 |

*Primary Examiner*—Stephen J. Tomsky
*Attorney, Agent, or Firm*—Jack W. Hayden

[57] ABSTRACT

A longitudinally extending body is provided with a longitudinally extending slot or opening. A hollow tubular member is secured adjacent one end of the body and is provided with a slot across its end which coincides with the slot in the body. Reed means are secured at one end to the body and extend longitudinally of the slot in the body and the tubular member, with the reed means having a portion extending laterally therefrom adjacent the hollow tubular member for manual vibration of said reed means relative to said body and member. The other end of the hollow tubular member is open to be positioned adjacent the mouth of the user for providing desired notes and tonal effects when the reed is manually vibrated. Clamp means on the body are movable longitudinally therealong for engagement with the reed at a predetermined or selected position to vary the length of the reed and thereby the pitch of the notes created by the vibration of the reed means.

12 Claims, 5 Drawing Figures

MOUTH ORGAN

SUMMARY OF THE INVENTION

Various types of mouth organs have been provided and are in use and are commonly referred to as Jews Harps. The present form incorporates a hollow tubular member and a longitudinal extending body having a longitudinally extending slot therein. Reed means extend longitudinally of the body slot and longitudinally of a slot in the hollow tubular member which coincides with the slot in the body. The hollow tubular member is closed off at one end surrounding the slot and the other end is open.

The open end of the hollow tubular member may be positioned over the user's mouth and various tonal effects and sounds may be produced when the reed is manually vibrated which would not otherwise be obtainable.

The device may consist of a plurality of tubular members which are secured together and with a body means having a slot extending longitudinally therein, such body means extending laterally from each of the tubular members and with reed means secured at one end to each of the bodies and extending longitudinally of the slot in the body and a slot in the tubular members. The size of the tubular members may be varied both as to length and as to diameter in order to provide an instrument which will create a multiplicity of tonal effects, sounds and over various ranges of notes.

The present invention will become more readily apparent from a consideration of the following description and drawings.

BRIEF DESCRIPTION OF THE PREFERRED EMBODIMENTS

Figure 4:
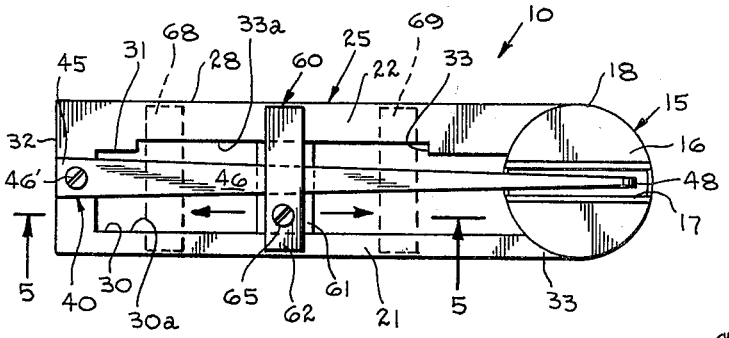
FIG. 4 illustrates an alternate embodiment of the invention including a clamp means mounted on the body for varying the length of the reed means mounted on the body.

Attention is first directed to FIG. 4 of the drawings wherein the invention is referred to generally by the numeral 10. A hollow tubular member referred to generally at 15 is secured adjacent one end 18 to a body 25 which extends laterally from the tubular member 15 as illustrated. The body 25 is shown as including a generally rectangular flat member 28 having an opening or slot 30 extending longitudinally therein. The slot 30 terminates as illustrated at 31 in spaced relation to the end 32 of the body 25 and intersects the other end represented at 33, of the body 25.

The hollow tubular member 15 is closed off as illustrated at 16 at the juncture of the end 18 of the hollow tubular member 15 with the body 25, and a slot 17 extends across the closed end 18 of hollow tubular member 15, such slot 17 being in axial alignment with the slot 30 in the body 25.

Reed means 40 are secured at one end 45 by any suitable means such as the screw 46' to the body 25, whereby such reed means 40 is pivotally mounted on the body 25. The reed means 40 may consist of a thin metal member 46 which extends longitudinally of the slot 30 in the body 25 and the slot 17 in the end 18 in the hollow tubular member 15. Also, if desired the reed 46 may taper from its end where it is connected to the body 25 towards its other end 48 as illustrated in FIG. 4 of the drawings. The end 48 of the reed is better illustrated in the other figure of the drawings and it will be noted that such end 48 includes a portion 50 which is bent or extends out of the longitudinal plane of the reed 46 and laterally relative thereto. Such portion 50 may include a portion 51 which is curled back upon the portion 50 to provide an enlargement which may be manually contacted to enable the reed 46 to be manually vibrated as illustrated in dotted line at 55 and 56.

Figure 5:
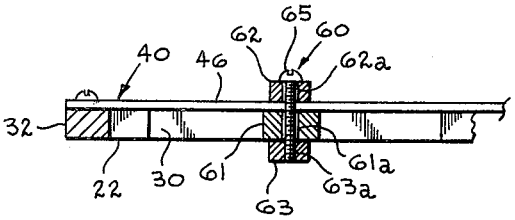
FIG. 5 is a sectional view on the line 5—5 of FIG. 4 illustrating further structural details of the clamp means.

In the form of the invention illustrated in FIGS. 4 and 5 of the drawings, suitable clamp means referred to at 60 are mounted on the body 25 and may be moved longitudinally therealong for engaging the reed 46 at various desired longitudinal points therealong. It will be noted that in FIGS. 4 and 5 form as shown in the drawings, the slot 30 includes a portion 33 which is of lesser extent in the length of the slot 30, but is wider than the slot 30 for receiving the member 61 therein. The member 61 is positioned between the laterally extending portions 62 and 63 of the clamp means 60 and all three members, namely 61, 62 and 63 are provided with openings **61*a*, 62*a* and 63*a* therethrough for receiving suitable means for securing them together such as the screw 65. The member 61 is of suitable width to extend from the edge 30*a* of the slot 30 to the edge 33*a* of the enlarged portion 33 of the slot 30. The members 62 and 63 overlie the side portion 21 and 22 of the body 25**.

Thus, the clamp means 60 may be moved longitudinally with in the slot 30 between the ends of the enlarged portion 33 and when the screw is tightened, the members 61, 62 and 63 clamp the reed 46, therebetween as well as the side portions 21 and 22 of the body 25 adjacent the longitudinally extending slot 30. Various positions of the clamp means 60 are illustrated in dotted lines at 68 and 69. When the pitch of the note created by the present invention is desired to be changed, the clamp means 60 may be moved longitudinally to engage the reed to in effect make it of shorter length than it would be if it were merely pivotally secured at one end 45 to the body 25 by the screw 46'.

Figure 3:
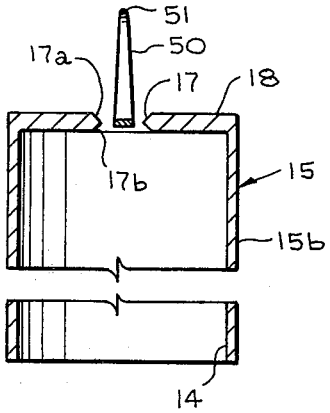
FIG. 3 is a section view on the line 3—3 of FIG. 1 illustrating further details of the relationships of the components of the present invention.
Figure 2:
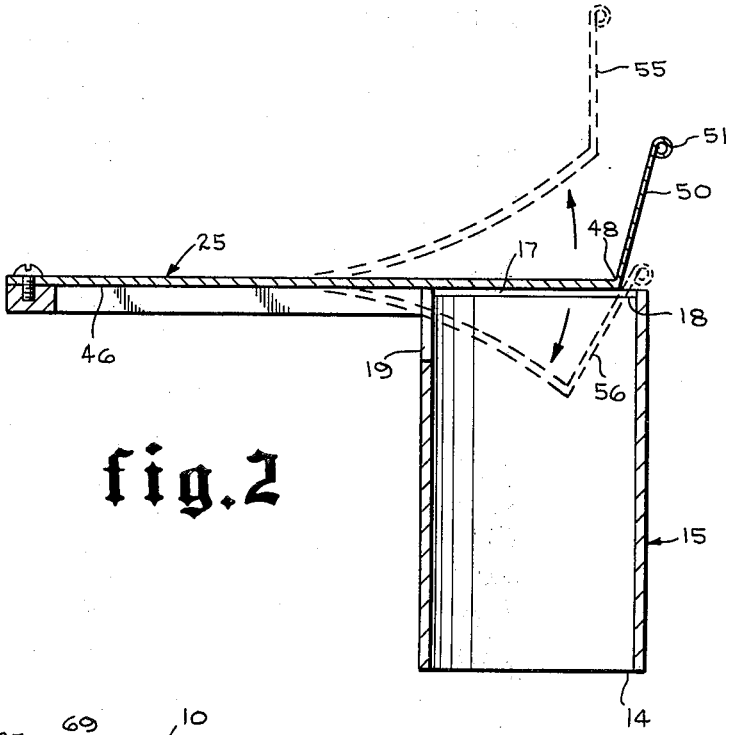
FIG. 2 is a section view on the line 2—2 of FIG. 1 illustrating further structural details of the present invention.

As more clearly illustrated in FIG. 2 of the drawings, the hollow tubular body 15 is also provided with a slot 19 extending longitudinally thereof, from adjacent end 18 and aligned with the slots 30 and 17 to enable the reed 46 to be vibrated manually relative to the body 25 and to the hollow tubular member 15 as illustrated in dotted line in FIG. 3.

In addition, the hollow tubular member 14 includes an open end 14 which may be positioned over the mouth of the user and the instrument is played by varying the position of the mouth or the shape of the mouth, or the relative amount of the mouth which covers the opening 14 while vibrations are imparted to the reed 46 manually. As previously noted, the clamp means 60 may be also employed in the invention if it is desired to further the effect the tonal quality and sound effects of the device.

Figure 1:
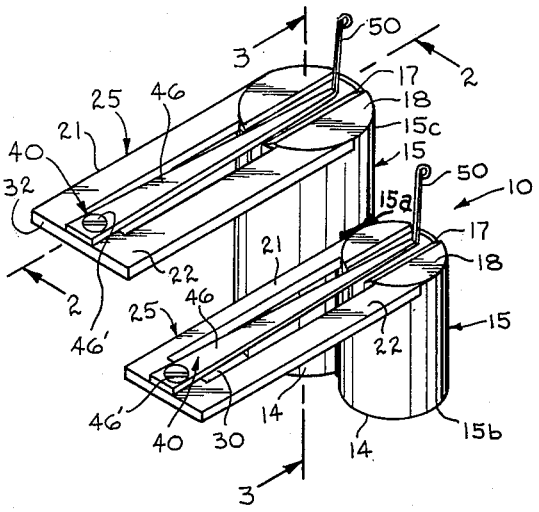
FIG. 1 is a perspective view illustrating one form of the invention wherein a pair of tubular members are secured together each having a longitudinal body secured thereto at one end and extending laterally therefrom. A slot is provided in the longitudinal body and housing with reed means secured to the body and extending longitudinally of the slots.

In FIG. 1 a form of the invention is illustrated again at 10, the construction of which is similar to that described with regard to FIG. 4 and 5 except that the clamp means 60 is eliminated, and in this form of the invention, a plurality of tubular members 15 are employed which are secured together by the weld shown at 15*a*. As illustrated, the pair of tubular members 15*b* and 15*c* are of different longitudinal extent, and are of different diameter to provide for additional different tonal effects from one instrument. Either one or both open ends 14 of the tubular hollow member 15*b* and 15*c* may be partially or completely positioned over the mouth and either one or both of the portions 50 of the reed means 46 of the tubular members 15*b* and 15*c* vibrated to provide desired effects.

It will be noted that, if desired, the open end 14 of the hollow tubular member 15*b* and hollow tubular member 15*c* terminates in substantially the same plane as shown in FIG. 1.

In the FIG. 1 form, the hollow tubular members 15 each include an end 18 which is secured to a laterally extending body 25, and each of the laterally extending bodies 25 is provided with a longitudinally extending slot 30 to define side portions 21 and 22 on each of the bodies 25, and such slot also extends axially of the body 25 and communicates with a slot 17 formed in each end 18 of each of the hollow tubular members 15*b* and 15*c* as described with regard to the FIGS. 4 and 5 modification. The reed means 40 is again secured adjacent the end 32 which extends between the side members 21 and 22 of each of the bodies 25 by suitable means as the screw 46'.

In FIG. 3 it will be noted that the slot 17 formed in the end 18 of hollow tubular members 15 is shown as having the converging side 17*a* and 17*b* although, the configuration of the slot 17 may be varied as desired. In addition, it will be noted that the laterally extending portion 50 of the reed 46 is shown as tapering from the end 48 of the reed 46 to the enlargement 51, although again the configuration of the reed means 46 may be varied without departing from the scope of the invention.

In use of the present invention, the open end 14 of each tubular member may be partially or completely positioned over the mouth or selectively positioned over the mouth and the portion 51 of the reed 46 selectively engaged in a well known manner to impart vibrations thereto. By changing the amount of opening 14 covered by the mouth as well as the shape of the mouth and the rate of vibration of the reed 46, a desired tonal and musical effect is obtained.

The foregoing disclosure and description of the invention are illustrative and explanatory thereof, and various changes in the size, shape, and materials as well as in the details of the illustrated construction may be made without departing from the spirit of the invention.

What is claimed is:

1. A mouth organ comprising:

a. a body;

b. an opening extending longitudinally of said body and intersecting one end thereof;

c. a hollow tubular member having one end closed with a slot extending thereacross and the other end open;

d. said closed end of said hollow tubular member being secured to said body so that the slot in said closed end communicates with and forms an axial extension of the longitudinal opening in said body;

e. said hollow tubular member extending laterally from said body to position said other open end of said hollow tubular member in spaced relation to said body for contact with the mouth;

f. reed means secured at one end to said body and having a longitudinal portion extending longitudinally of the opening in said body and the slot in said closed end; and g. said reed means having a portion extending laterally therefrom adjacent said hollow tubular member for manual vibration of the longitudinal portion of said reed means within the opening in said body and slot in said closed end to create sound.

2. The invention of claim 1 including adjustable clamp means mounted on said body and movable longitudinally thereof to engage said reed means at a predetermined position longitudinally thereof to thereby vary the length of said reed means and the pitch of the sound created by vibration of said reed means.

3. The invention of claim 1 wherein said reed means is removably secured to said body.

4. The invention of claim 2 wherein said reed means is removably secured to said body.

5. The invention of claim 1 wherein said hollow tubular member is slotted longitudinally to accomodate vibration of said reed means.

6. A mouth organ comprising:

a. a pair of hollow tubular members secured together, each of said tubular members having one end closed with a slot extending thereacross and the other end open;

b. a pair of body means;

c. each of said body means having an opening extending longitudinally thereof and intersecting an end thereof;

d. said closed end of said hollow tubular members each being secured to one of said pair of body means so that the slot in said closed end communicates with and forms an axial extension of the longitudinal opening in said body means;

e. said hollow tubular members each extending laterally from said body means to which each is secured to position said other open end of said hollow tubular members in spaced relation to said body means for contact with the mouth;

f. reed means secured at one end to each of said body means;

g. each reed means having a longitudinal portion extending longitudinally of the opening in the body means and the slot in said closed end; and h. each of said reed means having a portion extending laterally therefrom adjacent said hollow tubular members for manual vibration of the longitudinal portion of said reed means within the opening in said body and slot in said closed end to create sound.

7. The invention of claim 6 wherein said hollow tubular members are of different longitudinal extent.

8. The invention of claim 6 wherein said hollow tubular members are of different longitudinal extent and are of different diameters.

9. The invention of claim 6 including adjustable clamp means mounted on said body means and movable longitudinally thereof to engage said reed means at a predetermined position longitudinally thereof to thereby vary the length of said reed means and the pitch of the sound created by vibration of said reed means.

10. The invention of claim 6 wherein said reed means is removably secured to said body means.

11. The invention of claim 9 wherein said reed means is removably secured to said body means.

12. The invention of claim 6 wherein said hollow tubular members are slotted longitudinally to accomodate vibration of said reed means.

* * * * *